US009267185B2

(12) United States Patent
Sun

(10) Patent No.: US 9,267,185 B2
(45) Date of Patent: Feb. 23, 2016

(54) ROTATING VACUUM HEAT TREATMENT EQUIPMENT

(71) Applicant: China North Magnetic & Electronic Technology Co., LTD, Shenyang, Liaoning (CN)

(72) Inventor: Haotian Sun, Liaoning (CN)

(73) Assignee: China North Magnetic & Electronic Technology Co., LTD, Shenyang, Liaoning Province (CN)

( * ) Notice: Subject to any disclaimer, the term of this patent is extended or adjusted under 35 U.S.C. 154(b) by 159 days.

(21) Appl. No.: 14/047,915

(22) Filed: Oct. 7, 2013

(65) Prior Publication Data

US 2014/0327195 A1 Nov. 6, 2014

(30) Foreign Application Priority Data

May 5, 2013 (CN) ..... 2013 1 0160445

(51) Int. Cl.

| | |
|---|---|
| ***C21D 9/00*** | (2006.01) |
| ***B22F 1/00*** | (2006.01) |
| ***F27B 5/04*** | (2006.01) |
| ***F27B 7/06*** | (2006.01) |

(52) U.S. Cl.

CPC ..... *C21D 9/0031* (2013.01); *B22F 1/00* (2013.01); *F27B 5/04* (2013.01); *F27B 7/06* (2013.01)

(58) Field of Classification Search

CPC ..... C21D 9/0031; F27B 7/06
USPC ..... 266/250
See application file for complete search history.

(56) References Cited

U.S. PATENT DOCUMENTS

| | | | | |
|---|---|---|---|---|
| 3,111,394 | A * | 11/1963 | Weber et al. | 422/159 |
| 6,461,565 | B2 | 10/2002 | Tokuhara et al. | |
| 6,491,765 | B2 | 12/2002 | Okayama et al. | |
| 6,527,874 | B2 | 3/2003 | Li | |
| 6,537,385 | B2 | 3/2003 | Okayama et al. | |
| 2014/0327195 | A1 * | 11/2014 | Sun | 266/250 |

FOREIGN PATENT DOCUMENTS

| | | |
|---|---|---|
| CN | 1182548 | 12/2004 |
| CN | 1195600 | 4/2005 |
| CN | 1272809 | 8/2006 |

* cited by examiner

*Primary Examiner* — Scott Kastler

(57) ABSTRACT

A rotating vacuum heat treatment equipment, applicable for heat treatment of rare earth permanent magnetic devices, hydrogen pulverization of rare earth permanent magnetic alloy, and heat treatment of mechanical electronic components, mainly comprises: a vacuum unit, a gas cooling device, and a vacuum furnace, wherein an insulating layer is provided in the vacuum furnace, a heater is provided in the insulating layer, a rotating cylinder is provided in the heater, a nozzle, connected with pipelines of the gas cooling device, is provided on the insulating layer, and cooled gas is sprayed to the rotating cylinder via the nozzle.

10 Claims, 6 Drawing Sheets

ROTATING VACUUM HEAT TREATMENT EQUIPMENT

BACKGROUND OF THE PRESENT INVENTION

1. Field of Invention

The present invention belongs to a field of mechanical equipment, and especially relates to a field of rotating vacuum heat treatment equipments, which are applied in heat treatment of neodymium-iron-boronrare earth permanent magnetic devices, hydrogen pulverization of neodymium-iron-boronrare earth permanent magnetic alloy, heat treatment of small-sized mechanical electronic components.

2. Description of Related Arts

A neodymium-iron-boron rare earth permanent magnetic device has alloy comprising R, Fe, B, and M, wherein R refers to one or more rare earth elements, Fe refers to element Fe, B refers to element B, M refers to one or more elements selected from the element group consisting of Al, Co, Nb, Ga, Zr, Cu, V, Ti, Cr, Ni, and Hf.

A method for producing the neodymium-iron-boron rare earth permanent magnetic device is as follows.

1. Alloy Smelting Process

Smelting method of the alloys comprises an ingot casting process, which comprises heating raw materials of the neodymium-iron-boron rare earth permanent magnetic alloy to be an alloy in a molten state under a condition of vacuum or protective atmosphere; and then pouring the alloy in the molten state into a water-cooled mould under the condition of vacuum or protective atmosphere to form an alloy ingot. Preferably, the ingot casting process comprises moving or rotating a mould while pouring, in such a manner that an ingot thickness is 1~20 mm. Preferably, an alloy smelting method comprises a strip casting process, which comprises heating and melting an alloy, and pouring the molten alloy on a rotating roller with a water cooling device via a tundish, wherein the molten alloy becomes an alloy slice after cooled by the rotating roller, a cooling speed of the rotating roller is 100-1000° C./S, and a temperature of the cooled alloy slice is 550-400° C. Preferably, the alloy smelting method comprises cooling the alloy slice again by collecting the alloy slice with a rotating cylinder after the alloy slice leaves a rotating copper roller. Preferably, the alloy smelting method comprises cooling the alloy slice again by collecting the alloy slice with a turntable after the alloy slice leaves a rotating copper roller, wherein the turntable is below the copper roller, and an inert gas cooling device with a heat exchanger and a mechanical stirring device are provided above the turntable. Preferably, the alloy smelting method comprises preserving heat of the alloy slice by a secondary cooling device after the alloy slice leaves the rotating copper roller and before the alloy slice is cooled again, wherein a period of heat preserving is 10~120 min, and a temperature of heat preserving is 550~400° C.

2. Coarsely Pulverization Process

Coarsely pulverizing method of the alloy mainly comprises two methods, i.e., mechanical pulverization and hydrogen pulverization. The mechanical pulverization comprises pulverizing the alloy ingot smelted into particles having a grain diameter less than 5 mm with a pulverizing equipment, such as jaw crusher, hammer crusher, ball mill, rod mill, and disc mill, under a protection of nitrogen. Generally, the alloy slice is not pulverized by the jaw crusher and the hammer crusher. Coarseparticles obtained by a previous process are directly milled into fine particles having a grain diameter less than 5 mm by the pulverizing equipment, such as the ball mill, the rod mill, and the disc mill under the protection of nitrogen.

Another producing method of this process is hydrogen pulverization, which comprises: displacing the alloy slice or the alloy ingot obtained by the previous process into a vacuum hydrogen pulverization furnace, which is evacuated and filled with hydrogen, in such a manner that the alloy in the vacuum hydrogen pulverization furnace absorbs the hydrogen, wherein a temperature of hydrogen adsorption is usually less than 200° C., and a pressure of hydrogen adsorption is usually 50~200 KPa; after absorbing the hydrogen, evacuating the vacuum hydrogen pulverization furnace again and heating the vacuum hydrogen pulverization furnace to dehydrogenate the alloy, wherein a temperature of dehydrogenation is usually 600~900° C.; and cooling the particles after dehydrogenation, under the condition of vacuum or protective atmosphere, wherein the protective atmosphere is embodied as an argon protective atmosphere.

Preferably, the hydrogen pulverization method comprises: displacing the alloy ingot or the alloy slice into the rotating cylinder, which is evacuated and then filled with hydrogen, in such a manner that the alloy absorbs the hydrogen; stopping filling the rotating cylinder with hydrogen until the alloy is saturated with hydrogen; keeping the state for more than 10 minutes; evacuating the rotating cylinder, then heating the rotating cylinder while rotating the rotating cylinder to dehydrogenate the alloy under the condition of vacuum, wherein the temperature of dehydrogenation is usually 600~900° C.; and cooling the rotating cylinder after dehydrogenation.

Preferably, the hydrogen pulverization method relates to a method for producing rare earth permanent magnetic alloy continuously and its equipment. The equipment comprises a hydrogen adsorption chamber, a heating dehydrogenation chamber, a cooling chamber, chamber-isolating valves, a charging basket, a transmission device, a evacuating device; wherein the hydrogen adsorption chamber, the heating dehydrogenation chamber and the cooling chamber are respectively connected via the chamber-isolating valves, the transmission device is provided in upper portions of the hydrogen adsorption chamber, the heating dehydrogenation chamber and the cooling chamber, the charging basket is hanged on the transmission device, materials in the charging basket is transported into the hydrogen adsorption chamber, the heating dehydrogenation chamber and the cooling chamber in turn along the transmission device. When the equipment is working, the alloy ingot or the alloy slice is fed in the charging basket hanged on the transmission device, and the charging basket carrying the alloy ingot and the alloy slice is transported to the hydrogen adsorption chamber, the heating dehydrogenation chamber and the cooling chamber in turn, in such a manner that the alloy ingot and the alloy slice is processed with hydrogen adsorption, heating and dehydrogenation, and cooling in turn. Then the alloy is stored in a storage drum under the condition of vacuum or protective atmosphere.

3. Milling Process

A method for producing alloy powder comprises milling by a jet mill. The jet mill comprises: a feeder; a milling chamber, wherein a nozzle is provided in a lower portion thereof, and a sorting wheel is provided in an upper portion thereof; a weighing system for controlling a powder weight and a feeding speed in the milling chamber; a cyclone collector; a powder filter; and a gas compressor. Working gas is embodied as nitrogen, and a pressure of compressed gas is 0.6~0.8 MPa. When the jet mill is working, the powder obtained by the previous process is fed into the feeder of the jet mill firstly. The powder is added into the milling chamber under controlling of the weighing system. The powder is grinded by high-speed airflow sprayed by the nozzle. The powder grinded rises with the airflow. The powder meeting a milling requirement enters into the cyclone collector to be collected via the sorting wheel, and the coarse powder not meeting the milling requirement goes back to the lower portion of the milling chamber, under an effect of centrifugal force, to be grinded again. The powder entering into the cyclone collector is collected in a material collector in a lower portion of the cyclone collector as a finished product. Because the cyclone collector cannot collect all of the powder, a few fine powder is discharged with the airflow. This part of fine powder is filtered by the powder filter, and collected in a fine powder collector provided in a lower portion of the powder filter. Generally, a weight ratio between the fine powder and the whole powder is less than 15%, and a grain diameter of the fine powder is less than 1 μm. This part of powder has a rare earth content higher than an average rare earth content of the whole powder, so this part of powder is easy to be oxygenated, and is thrown away as waste powder. Preferably, an oxygen content in the atmosphere is controlled less than 50 ppm. This part of fine powder and the powder and the powder collected by the cyclone collector are added into a two-dimensional or three-dimensional mixing machine to mix with each other, and then compacted into compacts in a magnetic field under the protective atmosphere. A mixing period is generally more than 30 minutes, and the oxygen content in the atmosphere is less than 50 ppm. Preferably, a fine powder collector is provided between the cyclone collector and the powder filter, for collecting the fine powder discharged with the airflow from the cyclone collector. 10% of the fine powder can generally be collected. This part of the fine powder and the powder collected by the cyclone collector are added into the two-dimensional or three-dimensional mixing machine to mix with each other, and then compacted into compacts in the magnetic field under the protective atmosphere. Because of having a high content of rare earth, the fine powder is very suitable to be used as a rare-earth-rich phase in crystal boundaries, in such a manner that a magnetic performance is increased. To increase the magnetic performance, preferably, alloys of various compositions are respectively smelted according to the above processes, and the alloys are respectively milled into powders. Then the powders are mixed, and compacted in the magnetic field.

4. Compaction Process

Compaction of neodymium-iron-boron rare earth permanent magnets is most different from compaction of common powder metallurgy in compaction under an oriented magnetic field, so an electromagnet is provided on a press. Because neodymium-iron-boron rare earth permanent magnetic powder tends to be oxygenated, some patents proposed that an environmental temperature while compaction was required to be controlled between 5° C. and 35° C., a relative humidity was required to be 40%-65%, and an oxygen content was required to be 0.02-5%. To prevent the powder from being oxygenated, preferably, a compacting equipment comprises a protecting box, wherein gloves are provided on the protecting box, and the powder is processed with magnetic compaction under a protective atmosphere. Preferably, a cooling system is provided in a magnetic space in the protecting box, and a temperature of a magnetic space can be controlled. Moulds are displaced in a microthermal space which has a controllable temperature. The powder is compacted into compacts in a controlled temperature, and the temperature is controlled between −15° C. and 20° C. Preferably, the compacting temperature is less than 5° C. An oxygen content in the protecting box is less than 200 ppm, preferably, 150 ppm. An oriented magnetic field intensity in a chamber of the mould is generally 1.5-3 T. The magnetic field is oriented in advance before magnetic powder is compacted into the compacts, and the oriented magnetic field intensity remains unchanged while compaction. The oriented magnetic is embodied as a constant magnetic field, or a pulsating magnetic field, i.e., an alternating magnetic field. To decrease a compacting pressure, isostatic pressing is processed after the magnetic compaction, and then the material is fed into a sintering furnace to be sintered after the isostatic pressing.

5. Sintering Process

The sintering process is after the compaction process. The sintering process is finished in a vacuum sintering furnace, and under the condition of vacuum or protective atmosphere. A protective gas is embodied as argon. A sintering temperature is 1000-1200° C. A heat preservation period is generally 0.5-20 hours. Argon or nitrogen is used to cool the material after heat preservation. Preferably, a sintering equipment comprises a valve and a transferring box with gloves provided in front of the vacuum sintering furnace. The compacts processed with compaction are transported into the transferring box under the condition of protective atmosphere. The transferring box is filled with the protective gas. Under the condition of protective atmosphere, outer packings of the compacts are removed, and the compacts are fed into a sintering box. Then the valve between the transferring box and the sintering furnace is opened. The sintering box carrying the compacts is transported into the vacuum sintering furnace to be sintered by a transport mechanism in the transferring box. Preferably, a multi-chamber vacuum sintering furnace is used for sintering. Degasification, sintering, and cooling are respectively finished in different vacuum chambers. The transferring box with gloves is connected with the vacuum chambers via the valve. The sintering box passes through the vacuum chambers in turn. To increase the coercivity of magnets, the compacts are processed with aging process once or twice after sintering. An aging temperature of a first aging process is generally 400-700° C. A higher temperature of a second aging process is generally 800-1000° C., and a lower temperature of the second aging process is 400-700° C. The compacts are processed with machining and surface treatment after aging.

With expanding of application market of neodymium-iron-boron rare earth permanent magnetic materials, a problem of shortage of rare earth resources becomes more and more serious. Especially in fields of electronic components, energy-saving and controlling motors, auto parts, new energy automobiles, wind power, etc., more heavy rare earth is required to increase coercivity. Therefore, how to reduce a usage amount of the rare earth, especially the usage amount of the heavy rare earth, is an important topic in front of us. After exploration, we develop a rotating vacuum heat treatment equipment applicable for producing a neodymium-iron-boron rare earth permanent magnetic device having a high performance.

BRIEF SUMMARY OF THE INVENTION

The present invention provides a rotating vacuum heat treatment equipment applicable for producing a neodymium-iron-boron rare earth permanent magnetic device, mainly comprising a vacuum unit, gas cooling device, and a vacuum furnace; wherein an insulating layer is provided in the vacuum furnace, a heater is provided in the insulating layer, a rotating cylinder is provided in the heater, a reinforced slice is provided in the rotating cylinder, reinforcers in the reinforced slice are linear or auger-type, the rotating cylinder is supported by a supporting roller, the supporting roller drives the rotating cylinder to rotate via a supporting axle, the rotating cylinder is supported by the supporting roller, a cylinder axle is provided on one end of the rotating cylinder for driving the rotating cylinder to rotate, the rotating cylinder comprises the cylinder axle, provided on a first end or a second end of the rotating cylinder, for supporting the rotating cylinder and driving the rotating cylinder to rotate, a power device is provided outside the insulating layer for driving the rotating cylinder to rotate, a cover is provided on one end of the rotating cylinder, the rotating cylinder is made of monolayer material or multilayer material, when the rotating cylinder is made of the multilayer material, an inner layer is made of metal material, a nozzle is provided on the insulating layer, the nozzle is connected with pipelines of the gas cooling device, cooled gas is sprayed to the rotating cylinder via the nozzle, the rotating cylinder carries parts, balls, and particles containing rare earth elements, and a number of the rotating cylinder is more than two.

The present invention is applicable for improving hydrogen pulverization technology, which comprises: displacing an alloy ingot or an alloy slice into a hydrogen-absorbing pot, which is evacuated and then filled with hydrogen. The alloy absorbs the hydrogen. Filling the rotating cylinder with hydrogen is stopped, after the alloy is saturated with hydrogen. Then the alloy, which has absorbed hydrogen, is fed into the rotating vacuum heat treatment equipment provided by the present invention to be dehydrogenated under a condition of vacuum. A dehydrogenation temperature is 600-900° C. The alloy is cooled by argon after dehydrogenation.

The present invention is applicable for improving heat treatment technology. The compacts are processed with machining into parts after sintering, according to a final size and shape of the rare earth permanent magnetic device or an approximate final size and shape of the rare earth permanent magnetic device. After machining, the parts are processed with oil removing, washing, and drying. Then the parts are fed into the rotating cylinder in a rotating vacuum heat treatment furnace. The rotating cylinder also carries balls and particles containing rare earth elements. The rare earth elements are one or more elements selected from the element group consisting of Dy, Tb, Pr and Nd.

When the rotating vacuum heat treatment equipment is working, the rotating cylinder is heated and rotated after being evacuated. The cylinder rotates in one direction or in two directions alternately. The rotating cylinder is kept warm after a temperature increases to a holding temperature. The rotating cylinder is cooled by gas after heat preservation. Heating, heat preservation, and cooling can be processed once or a plurality of times. Vacuum degree of vacuum heat treatment is controlled in a range of $5\sim5\times10^{-4}$ Pa. The holding temperature is controlled in a range of 600-1000° C. When the holding temperature is lower than 600° C., effects are not obvious. When the holding temperature is higher than 1000° C., the parts will be out of shape. A period of holding temperature is 0.5~20 hours. When the period is less than 0.5 hours, the effects are not obvious. When the period is more than 20 hours, coercivity is not increased obviously. The rotating cylinder is cooled with argon after heat preservation. Then the temperature is increased to 400-700° C. after cooling. After preserving heat for 0.5~12 hours, the rotating cylinder is cooled with argon again.

The parts are selectively processed with post processes, such as grinding, chamfering, sandblasting, electroplating, electrophoresis, spraying, and vacuum coating, to meet requirements of the parts, such as size, accuracy, and corrosion resistance.

The present invention is applicable for producing rare earth permanent magnetic materials having high performance, especially applicable for motor magnets of new energy automobiles, motor magnets of household appliances, energy-saving motor magnets, motor magnets and sensor magnets applicable for auto parts, magnets of hard disk drives, magnets of electronic electro-acoustic devices. The coercivity of rare earth permanent magnets is obviously increased, under a condition of equal content of heavy rare earth, by applying rotating vacuum heat treatment equipment technology, in such a manner that usage amount of heavy rare earth is saved, and scarce resources are protected.

These and other objectives, features, and advantages of the present invention will become apparent from the following detailed description, the accompanying drawings, and the appended claims.

Figure 1:
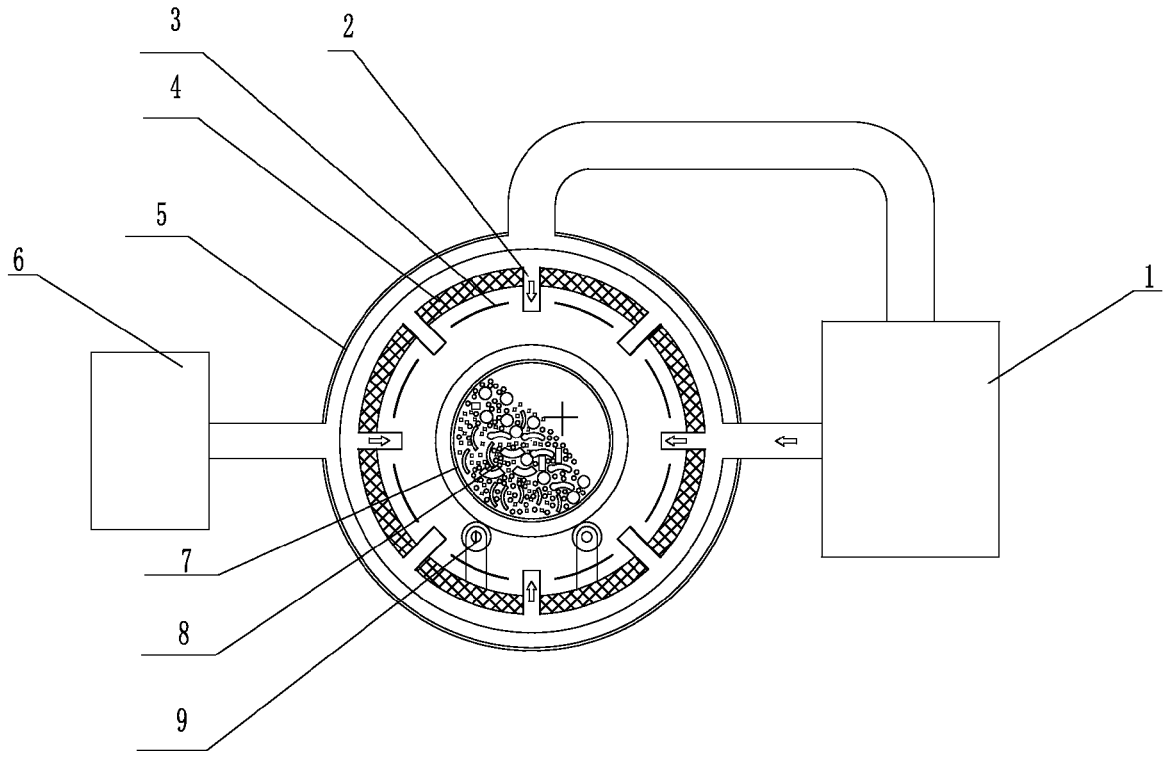
FIG. 1 is a sketch view of a rotating vacuum heat treatment equipment according to a preferred embodiment of the present invention.
Figure 2:
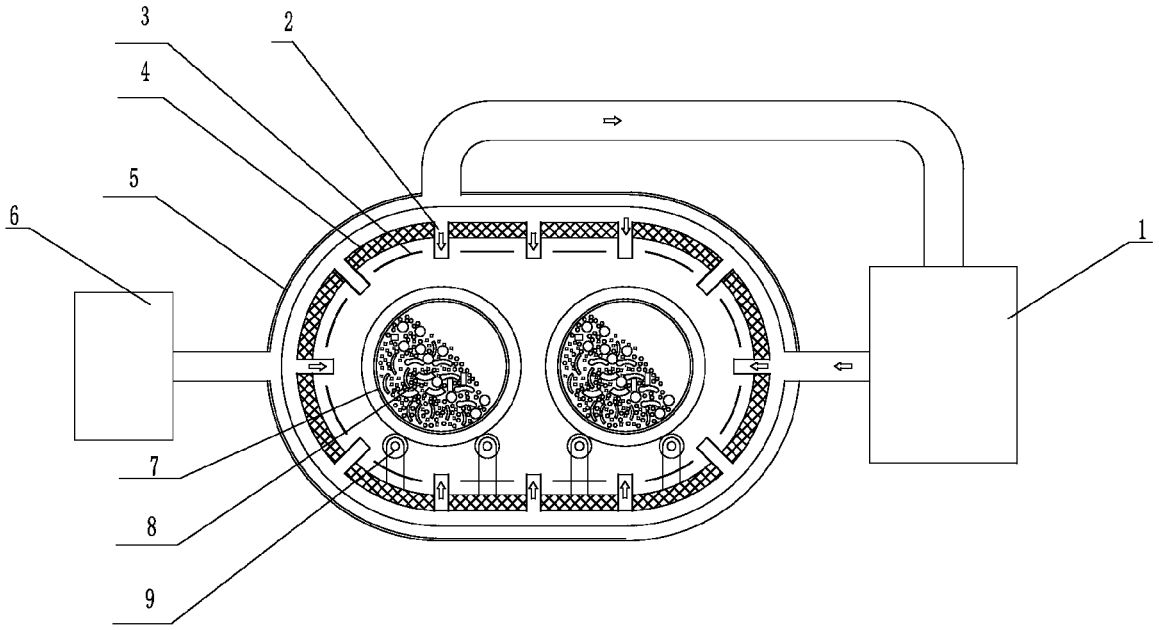
FIG. 2 is a sketch view of a rotating vacuum heat treatment equipment with a plurality of rotating cylinders according to a preferred embodiment of the present invention.
Figure 3:
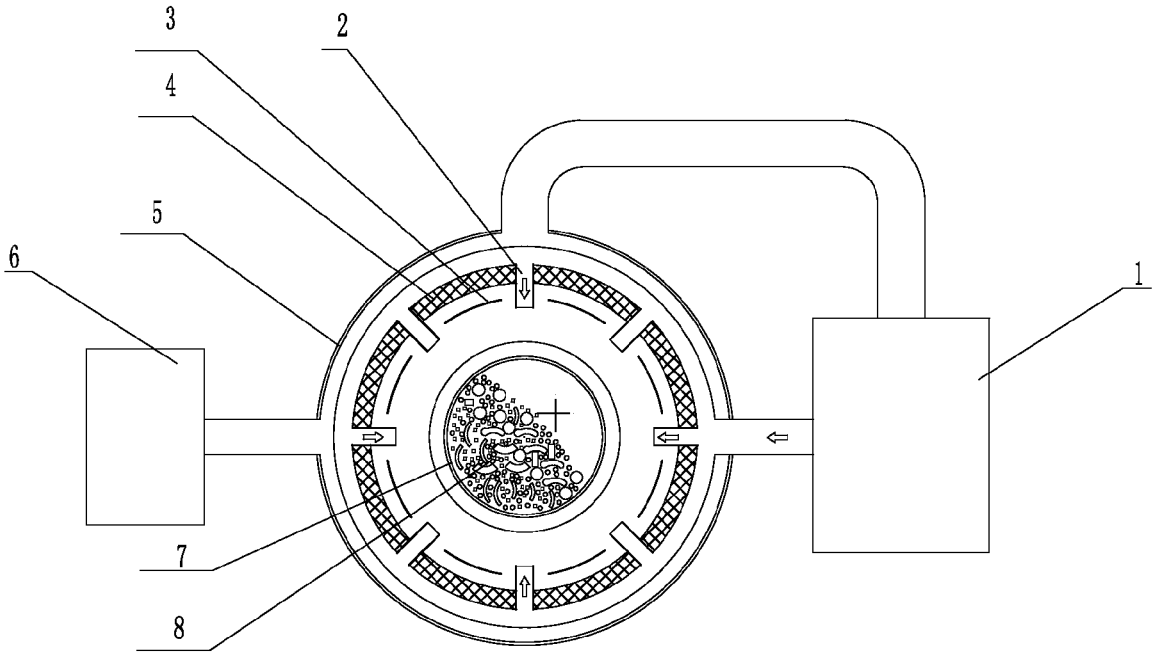
FIG. 3 is a sketch view of a rotating vacuum heat treatment equipment without a supporting roller according to a preferred embodiment of the present invention.

Numbers in the drawings refer to elements as follows. 1, gas cooling device; 2, nozzle; 3, heater; 4, insulating layer; 5, vacuum furnace; 6, vacuum unit; 7, rotating cylinder; 8, materials; 9, supporting roller; 10, axle of rotating cylinder; 11, reinforced plate; 12, cover; 13, axle of supporting roller

DETAILED DESCRIPTION OF THE INVENTION

The embodiments are described as follows to further illustrate remarkable effects of the present invention.

Figure 4:
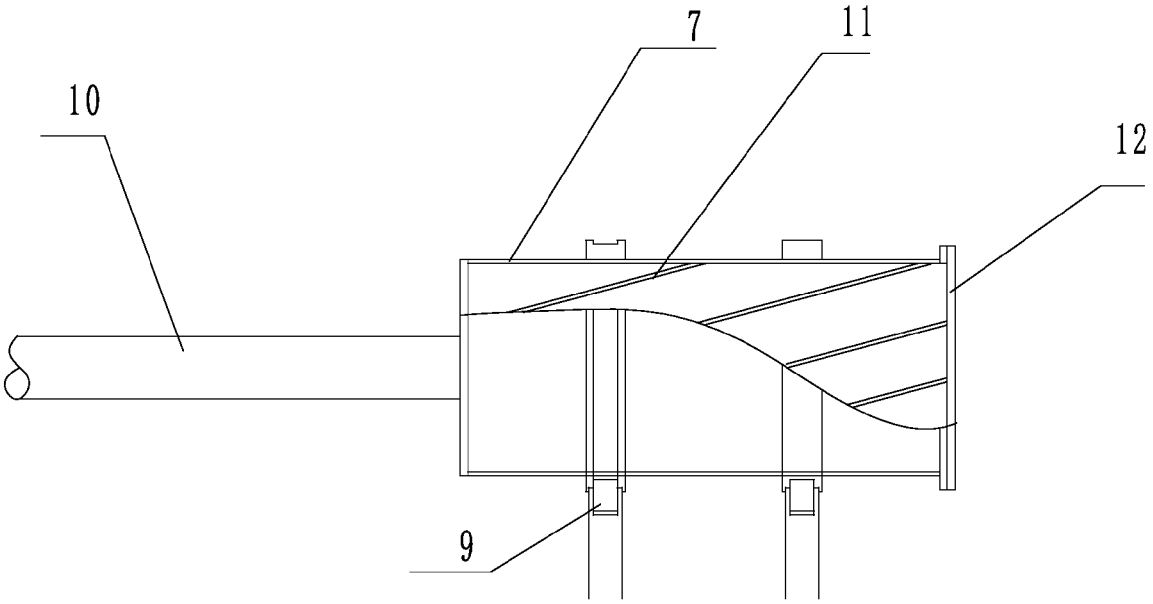
FIG. 4 is a sketch view of a rotating cylinder with a supporting roller and an axle in an end portion thereof according to a preferred embodiment of the present invention.
Figure 5:
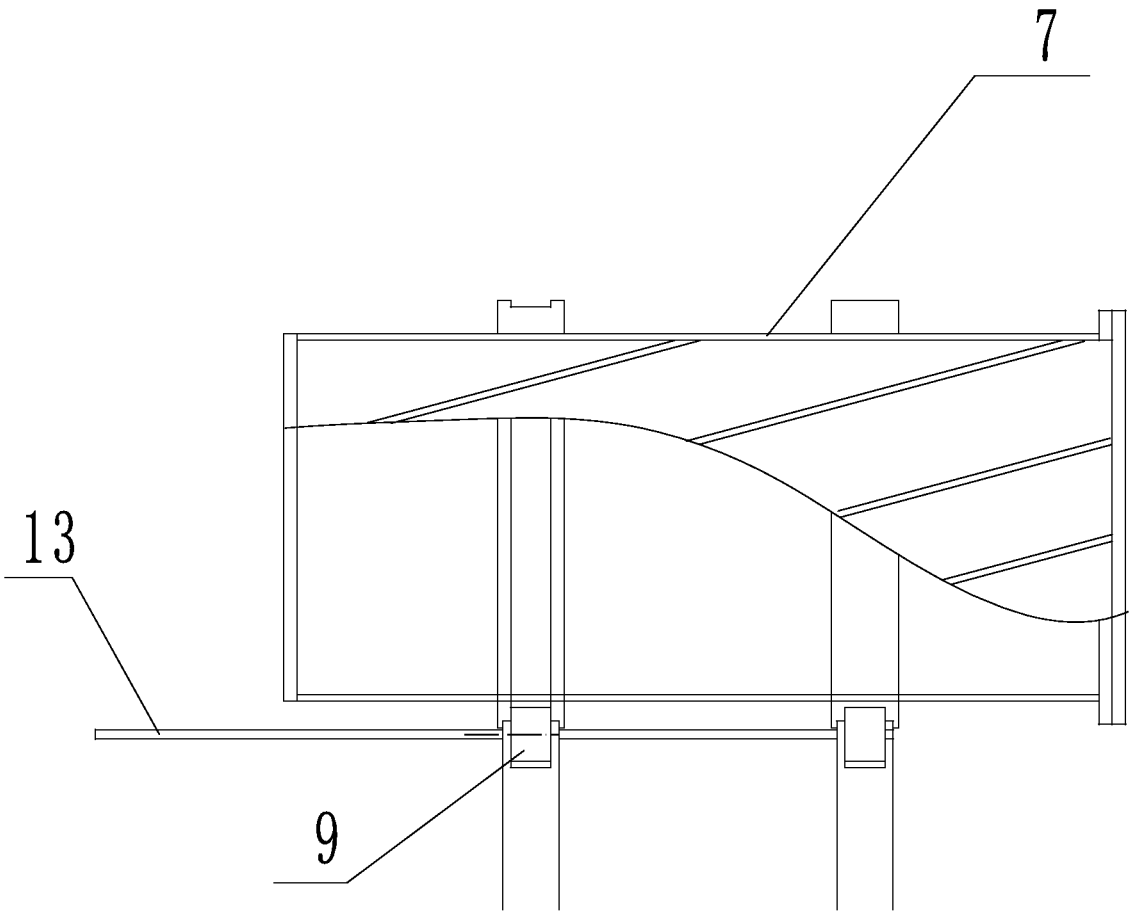
FIG. 5 is a sketch view of a rotating cylinder having a supporting roller rotating initiatively.
Figure 6:
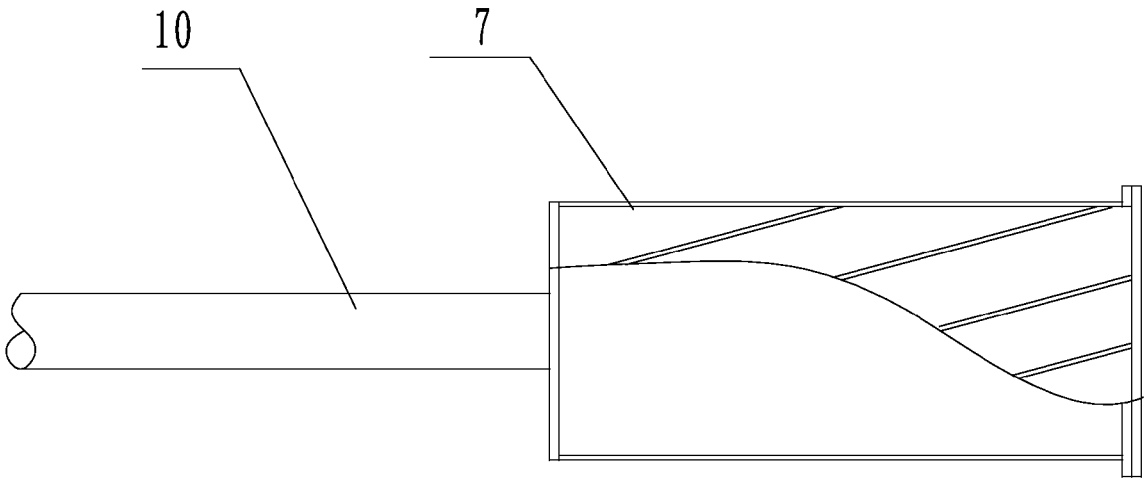
FIG. 6 is a sketch view of a rotating cylinder having an axle in an end portion thereof for supporting the rotating cylinder.

Referring to FIG. 1~FIG. 6, a rotating vacuum heat treatment equipment in the present invention comprises a vacuum unit 6, a gas cooling device 1, and a vacuum furnace 5; wherein an insulating layer 4 is provided in the vacuum furnace 5, a nozzle 2 is provided on the insulating layer 4, the nozzle 2 is connected with pipelines of the gas cooling device 1, a heater 3 is provided in the insulating layer 4, a rotating cylinder 7 is provided in the heater 3, a reinforced plate 11 is provided in the rotating cylinder 7, reinforcers in the reinforced plate 11 is linear or auger-type, the reinforced plate is continuous and not continuous. Referring to FIG. 4, the rotating cylinder 7 is supported by a supporting roller 9, and an axle of the rotating cylinder 10 drives the rotating cylinder 7 to rotate. Referring to FIG. 5, the rotating cylinder 7 is supported by the supporting roller 9, and an axle of the supporting roller 13 drives the rotating cylinder 7 to rotate. Referring to FIG. 6, the rotating cylinder 7 is supported by the axle of the rotating cylinder 10, and the axle of the rotating cylinder 10 drives the rotating cylinder 7 to rotate. A cover 12 is provided on one end of the rotating cylinder 7. The rotating cylinder 7 is made of monolayer material or multilayer material, wherein when the rotating cylinder 7 is made of the multilayer material, an inner layer is made of metal material. The rotating cylinder carries parts, balls, and particles containing rare earth elements, and a number of the rotating cylinder 7 is more than two.

Embodiment 1

600 kg of alloy A is taken to be smelted, and composition of the alloy is listed in Table 1. The alloy in a molten state is poured on a rotating cooling roller with a water cooling device to be cooled and form an alloy slice. Then the alloy slice is coarsely pulverized by a vacuum hydrogen pulverization furnace. The alloy is processed with a jet mill after hydrogen pulverization. Powder is fed into a pressing machine with an oriental magnetic field to be compacted into compacts. Each of the compacts has a size of 62×52×42 mm. A direction of an oriented magnetic field is embodied as a direction of a height, i.e. 42 mm. The compacts are processed with isostatic pressing after being compacted. Then the compacts are transported into a vacuum sintering furnace to be sintered. A sintering temperature is 1060° C. After the compacts are circularly cooled by argon to 80° C., the compacts are taken out to be processed with machining, wherein the compacts are processed into four types of parts, i.e., bigger square slice (60×25×10), smaller square slice (30×20×3), sector (R30×r40, radian 60°, thickness 5), and concentric tile (R60×r55, chord length 20, height 30). After the parts are processed with oil removing, washing, and drying, the parts, balls, and particles containing rare earth are fed into the rotating cylinder of the rotating vacuum heat treatment equipment. After the rotating cylinder is evacuated to a vacuum degree of $5\times10^{-1}$ Pa, the rotating cylinder is heated and rotated. The vacuum degree is controlled more than $5\times10^{-1}$ Pa. After a temperature of the rotating cylinder reaches 950° C., the rotating cylinder is processed with heat preservation. After being processed with the heat preservation for 2 hours, the rotating cylinder is cooled by argon to 100° C. Then the temperature of the rotating cylinder is increased to 480° C. After being processed with the heat preservation for 4 hours, the rotating cylinder is cooled by argon to less than 80° C. Then the parts are taken out of the furnace.

The parts are selectively processed with post processes, such as grinding, chamfering, sandblasting, electroplating, electrophoresis, spraying, and vacuum coating, to meet requirements of the parts, such as size, accuracy, and corrosion resistance. Testing results of magnetic performance are shown in Table 2.

Embodiment 2

600 kg of alloy B is taken to be smelted, and composition of the alloy is listed in Table 1. The alloy in a molten state is poured on a rotating cooling roller with a water cooling device to be cooled and form an alloy slice. The alloy slice leaves the cooling roller and falls into a turntable. The alloy slice is mixed mechanically and cooled by argon in the turntable. Then the alloy slice is coarsely pulverized by a vacuum hydrogen pulverization furnace. The alloy is processed with a jet mill after hydrogen pulverization. An oxygen content of the jet mill is 10 ppm. Powder is fed into a pressing machine with an oriental magnetic field to be compacted into compacts under a protection of nitrogen. An oxygen content in a protecting box is 90 ppm. An intensity of the oriental field is 1.8 T. Each of the compacts has a size of 62×52×42 mm. A direction of an oriented magnetic field is embodied as a direction of a height, i.e. 42 mm. The compacts are packaged in the protecting box after being compacted. The compacts are transported into a vacuum sintering furnace to be sintered, after being processed with isostatic pressing. A sintering temperature is 1060° C. After the compacts are circularly cooled by argon to 80° C., the compacts are taken out to be processed with machining, wherein the compacts are processed into four types of parts, i.e., bigger square slice (60×25×10), smaller square slice (30×20×3), sector (R30×r40, radian 60°, thickness 5), and concentric tile (R60×r55, chord length 20, height 30). After the parts are processed with oil removing, washing, and drying, the parts, balls, and particles containing rare earth are fed into the rotating cylinder of the rotating vacuum heat treatment equipment. After the rotating cylinder is evacuated to a vacuum degree of $5\times10^{-2}$ Pa, the rotating cylinder is heated and rotated. The vacuum degree is controlled more than $5\times10^{-2}$ Pa. After a temperature of the rotating cylinder reaches 850° C., the rotating cylinder is processed with heat preservation. After being processed with heat preservation for 10 hours, the rotating cylinder is cooled by argon to 100° C. Then the temperature of the rotating cylinder is increased to 450° C. After being processed with heat preservation for 6 hours, the rotating cylinder is cooled by argon to less than 80° C. Then the parts are taken out of the furnace.

The parts are selectively processed with post processes, such as grinding, chamfering, sandblasting, electroplating, electrophoresis, spraying, and vacuum coating, to meet requirements of the parts, such as size, accuracy, and corrosion resistance. Testing results of magnetic performance are shown in Table 2.

Embodiment 3

600 kg of alloy C is taken to be smelted, and composition of the alloy is listed in Table 1. The alloy in a molten state is poured on a rotating cooling roller with a water cooling device to be cooled and form an alloy slice. The alloy slice leaves the cooling roller and falls into a rotating cylinder. After the rotating cylinder is processed with heat preservation for 30 minutes, the rotating cylinder is cooled. Then the alloy slice is coarsely pulverized by a vacuum hydrogen pulverization furnace. The alloy is processed with a jet mill after hydrogen pulverization. An oxygen content of the jet mill is 30 ppm. Powder collected by a cyclone collector and fine powder collected by a powder filter are mixed by a two-dimensional mixing machine for 60 minutes under protection of nitrogen, and then fed into a pressing machine with an oriental magnetic field and the protection of nitrogen to be compacted into compacts. An oxygen content in a protecting box is 110 ppm. An intensity of the oriental field is 1.8 T. A temperature in a mould chamber is 0° C. Each of the compacts has a size of 62×52×42 mm. A direction of an oriented magnetic field is embodied as a direction of a height, i.e. 42 mm. The compacts are packaged in the protecting box after being compacted. Then the compacts are taken out of the protecting box, and processed with isostatic pressing. A pressure of the isostatic pressing is 200 MPa. Then the compacts are transported into a vacuum sintering furnace to be sintered. A sintering temperature is 1060° C. After the compact is circularly cooled by argon to 80° C., the compacts are taken out to be processed with machining, wherein the compacts are processed into four types of parts, i.e., bigger square slice (60×25×10), smaller square slice (30×20×3), sector (R30×r40, radian 60°, thickness 5), and concentric tile (R60×r55, chord length 20, height 30). After the parts are processed with oil removing, washing, and drying, the parts, balls, and particles containing rare earth are fed into the rotating cylinder of the rotating vacuum heat treatment equipment. After the rotating cylinder is evacuated to a vacuum degree of $5\times10^{-1}$ Pa, the rotating cylinder is heated and rotated. The vacuum degree is controlled more than 5 Pa. After a temperature of the rotating cylinder reaches 750° C., the rotating cylinder is processed with heat preservation. After being processed with heat preservation for 20 hours, the rotating cylinder is cooled by argon to 100° C. Then the temperature of the rotating cylinder is increased to 500° C. After being processed with heat preservation for 3 hours, the rotating cylinder is cooled by argon to less than 80° C. Then the parts are taken out of the furnace.

The parts are selectively processed with post processes, such as grinding, chamfering, sandblasting, electroplating, electrophoresis, spraying, and vacuum coating, to meet requirements of the parts, such as size, accuracy, and corrosion resistance. Testing results of magnetic performance are shown in Table 2.

Embodiment 4

600 kg of alloy D is taken to be smelted, and composition of the alloy is listed in Table 1. The alloy in a molten state is poured on a rotating cooling roller with a water cooling device to be cooled and form an alloy slice. The alloy slice leaves the cooling roller and falls into a rotating cylinder. After the rotating cylinder is kept warm for 30 minutes, the rotating cylinder is cooled. Then the alloy slice is coarsely pulverized by a vacuum hydrogen pulverization furnace. The alloy is processed with a jet mill after hydrogen pulverization. An oxygen content of the jet mill is 30 ppm. Powder collected by a cyclone collector and fine powder collected by a fine powder collector are mixed by a two-dimensional mixing machine for 60 minutes under protection of nitrogen, and then fed into a pressing machine with an oriental magnetic field and the protection of nitrogen to be compacted into compacts. An oxygen content in a protecting box is 110 ppm. An intensity of the oriental field is 1.8 T. A temperature in a mould chamber is −5° C. Each of the compacts has a size of 62×52×42 mm. A direction of an oriented magnetic field is embodied as a direction of a height, i.e. 42 mm. The compacts are packaged in the protecting box after being compacted. Then the compacts are taken out of the protecting box, and processed with isostatic pressing. A pressure of the isostatic pressing is 200 MPa. Then the compacts are transported into a vacuum sintering furnace to be sintered. A sintering temperature is 1060° C. After the compacts are circularly cooled by argon to 80° C., the compacts are taken out to be processed with machining, wherein the compacts are processed into four types of parts, i.e., bigger square slice (60×25×10), smaller square slice (30×20×3), sector (R30×r40, radian 60°, thickness 5), and concentric tile (R60×r55, chord length 20, height 30). After the parts are processed with oil removing, washing, and drying, the parts, balls, and particles containing rare earth are fed into the rotating cylinder of the rotating vacuum heat treatment equipment. After the rotating cylinder is evacuated to a vacuum degree of $5\times10^{-1}$ Pa, the rotating cylinder is heated and rotated. The vacuum degree is controlled more than 5 Pa. After a temperature of the rotating cylinder reaches 650° C., the rotating cylinder is processed with heat preservation. After being processed with heat preservation for 20 hours, the rotating cylinder is cooled by argon to 100° C. Then the temperature of the rotating cylinder is increased to 500° C. After being processed with heat preservation for 3 hours, the rotating cylinder is cooled by argon to less than 80° C. Then the parts are taken out of the furnace.

The parts are selectively processed with post processes, such as grinding, chamfering, sandblasting, electroplating, electrophoresis, spraying, and vacuum coating, to meet requirements of the parts, such as size, accuracy, and corrosion resistance. Testing results of magnetic performance are shown in Table 2.

TABLE 1

Composition of alloy

| Num. | Code | Composition |
|---|---|---|
| 1 | A | Nd30Dy1Fe67.9B0.9Al0.2 |
| 2 | B | Nd30Dy1Fe67.5Co1.2Cu0.1B0.9Al0.1 |
| 3 | C | (Pr0.2Nd0.8)25Dy5Fe67.4Co1.2Cu0.3B0.9Al0.2 |
| 4 | D | (Pr0.2Nd0.8)25Dy5Tb1Fe65Co2.4Cu0.3B0.9Al0.2Ga0.1Zr0.1 |

TABLE 2

Measuring results of magnetic performance of special heat treatment

| Num. | Code | Size and shape | Number of part (piece/box) | Surface treatment | Remanence (Gs) | Coercivity (Oe) |
|---|---|---|---|---|---|---|
| Embodiment 1 | A | Bigger square slice | 180 | Electroplating | 13970 | 17994 |
| Embodiment 1 | A | Smaller square slice | 500 | Electrophoresis | 13810 | 17699 |
| Embodiment 1 | A | Sector | 400 | Parkerising | 13983 | 17551 |
| Embodiment 1 | A | Concentric tile | 300 | Spray coating | 13975 | 17787 |
| Embodiment 2 | B | Bigger square slice | 180 | Electroplating | 13979 | 17841 |
| Embodiment 2 | B | Smaller square slice | 500 | Electrophoresis | 13991 | 17616 |
| Embodiment 2 | B | Sector | 400 | Parkerising | 13995 | 17670 |
| Embodiment 2 | B | Concentric tile | 300 | Spray coating | 14014 | 17977 |
| Embodiment 3 | C | Bigger square slice | 180 | Electroplating | 12598 | 28660 |
| Embodiment 3 | C | Smaller square slice | 500 | Electrophoresis | 12565 | 29230 |

TABLE 2-continued

| Measuring results of magnetic performance of special heat treatment | | | | | | |
|---|---|---|---|---|---|---|
| Num. | Code | Size and shape | Number of part (piece/box) | Surface treatment | Remanence (Gs) | Coercivity (Oe) |
| Embodiment 3 | C | Sector | 400 | Parkerising | 12540 | 28750 |
| Embodiment 3 | C | Concentric tile | 300 | Spray coating | 12590 | 28670 |
| Embodiment 4 | D | Bigger square slice | 180 | Electroplating | 12630 | 28830 |
| Embodiment 4 | D | Smaller square slice | 500 | Electrophoresis | 12580 | 29240 |
| Embodiment 4 | D | Sector | 400 | Parkerising | 12640 | 28920 |
| Embodiment 4 | D | Concentric tile | 300 | Spray coating | 12595 | 28810 |

Embodiment 5

600 kg of the alloy A, B, C, or D is taken to be smelted, and composition of the alloy is listed in Table 1. The alloy is processed with casting to form an ingot having a thickness of 12 mm. Other processes are same as embodiment 1~4. Results are shown in Table 3.

TABLE 3

| Measuring results of magnetic performance of special heat treatment | | | | | | |
|---|---|---|---|---|---|---|
| Num. | Code | Size and shape | Number of part (piece/box) | Surface treatment | Remanence (Gs) | Coercivity (Oe) |
| 1 | A | Bigger square slice | 180 | Electroplating | 13962 | 17473 |
| 2 | A | Smaller square slice | 500 | Electrophoresis | 13904 | 17178 |
| 3 | A | Sector | 400 | Parkerising | 13961 | 17084 |
| 4 | A | Concentric tile | 300 | Spray coating | 13987 | 17267 |
| 5 | B | Bigger square slice | 180 | Electroplating | 13950 | 17321 |
| 6 | B | Smaller square slice | 500 | Electrophoresis | 13987 | 17143 |
| 7 | B | Sector | 400 | Parkerising | 13962 | 17165 |
| 8 | B | Concentric tile | 300 | Spray coating | 14031 | 17478 |
| 9 | C | Bigger square slice | 180 | Electroplating | 12561 | 28565 |
| 10 | C | Smaller square slice | 500 | Electrophoresis | 12559 | 28767 |
| 11 | C | Sector | 400 | Parkerising | 12548 | 28235 |
| 12 | C | Concentric tile | 300 | Spray coating | 12576 | 28154 |
| 13 | D | Bigger square slice | 180 | Electroplating | 12598 | 28343 |
| 14 | D | Smaller square slice | 500 | Electrophoresis | 12579 | 28731 |
| 15 | D | Sector | 400 | Parkerising | 12618 | 28422 |
| 16 | D | Concentric tile | 300 | Spray coating | 12565 | 28790 |

Comparison Example 1

600 kg of the alloy A, B, C, or D is taken to be smelted, and composition of the alloy is listed in Table 1. The alloy is processed with casting to form an ingot having a thickness of 12 mm. The alloy is processed with a jet mill after hydrogen pulverization. An oxygen content in atmosphere of the jet mill is 30 ppm. Weights of powder collected by a cyclone collector and fine powder collected by a powder filter are shown in Table 4. The powder collected by the cyclone collector and the fine powder collected by the powder filter are mixed by a two-dimensional mixing machine for 30 minutes under protection of nitrogen, and then fed into a pressing machine with an oriental magnetic field and the protection of nitrogen to be compacted into compacts. An oxygen content in a protecting box is 90 ppm. An intensity of the oriental field is 1.8 T. A temperature in a chamber of a mould is 3° C. Each of the compacts has a size of 62×52×42 mm. A direction of an oriented magnetic field is embodied as a direction of a height, i.e. 42 mm. The compacts are packaged in the protecting box after being compacted. The compacts are taken out from the protecting box, and processed with isostatic pressing, and a pressure of the isostatic pressing is 200 MPa. Then the compacts are transported into a vacuum sintering furnace to be sintered and processed with aging treatment twice, wherein sintering temperature is 1060° C., and aging temperatures are respectively 850° C. and 580° C. Measuring results of magnetic performance are shown in Table 4.

TABLE 4

Measuring results of magnet magnetic performance of ingot

| Num. | Code | Weight of power (Kg) | Weight of fine powder (Kg) | Weight of fine power added (Kg) | Remanence (Gs) | Coercivity (Oe) |
|---|---|---|---|---|---|---|
| 1 | A | 530 | 40 | 40 | 13965 | 14565 |
| 2 | B | 535 | 35 | 35 | 14000 | 14400 |
| 3 | C | 540 | 30 | 30 | 12390 | 25320 |
| 4 | D | 540 | 30 | 30 | 12560 | 26500 |

Comparison Example 2

600 kg of the alloy A, B, C, or D is taken to be smelted, and composition of the alloy is listed in Table 1. The alloy in a molten state is poured on the rotating cooling roller with the water cooling device to be cooled and form an alloy slice. Then the alloy slice is coarsely pulverized by the vacuum hydrogen pulverization furnace. The alloy is processed with the jet mill after hydrogen pulverization. An oxygen content in atmosphere of the jet mill is 30 ppm. Weights of powder collected by a cyclone collector and fine powder collected by a fine powder collector are shown in Table 5. The powder collected by the cyclone collector and the fine powder collected by the fine powder collector are mixed by a two-dimensional mixing machine for 30 minutes under protection of nitrogen, and then fed into a pressing machine with an oriental magnetic field and the protection of nitrogen to be compacted into compacts. An oxygen content in a protecting box is 110 ppm. An intensity of the oriental field is 1.8 T. A temperature in a chamber of a mould is 3° C. Each of the compacts has a size of 62×52×42 mm. A direction of an oriented magnetic field is embodied as a direction of a height, i.e. 42 mm. The compacts are packaged in the protecting box after being compacted. The compacts are taken out from the protecting box, and processed with isostatic pressing, and a pressure of the isostatic pressing is 200 MPa. Then the compacts are transported into a vacuum sintering furnace to be sintered, and processed with aging treatment twice, wherein sintering temperature is 1060° C., and aging temperatures are respectively 850° C. and 580° C. Measuring results of magnetic performance are shown in Table 5.

TABLE 5

Measuring results of magnetic performance of rapidly solidified alloy

| Num. | Code | Weight of power (Kg) | Weight of fine powder (Kg) | Weight of fine power added (Kg) | Remanence (Gs) | Coercivity (Oe) |
|---|---|---|---|---|---|---|
| 1 | A | 535 | 35 | 40 | 14112 | 15563 |
| 2 | B | 545 | 30 | 35 | 14180 | 15500 |
| 3 | C | 545 | 30 | 30 | 12540 | 26230 |
| 4 | D | 545 | 30 | 30 | 12680 | 27800 |

The above embodiments are compared with the comparison examples. It is found that the coercivity of products obtained by the rotating vacuum heat treatment equipment in the present invention is significantly higher than the coercivity of products in the comparison examples. The present invention is applicable in producing rare earth permanent magnetic materials and devices having high performance.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A rotating vacuum heat treatment equipment, comprising: a vacuum unit, a gas cooling device, and a vacuum furnace, wherein an insulating layer is provided in said vacuum furnace, a heater is located interiorly of said insulating layer, and at least one rotating cylinder is located interiorly of said heater; said rotation vacuum heat treatment equipment further comprises balls and particles containing rare earth elements, placed inside said rotating cylinder, so as to process a work piece with said balls and particles;

wherein said rare earth elements are one or more elements selected from a group consisting of Dy, Tb, Pr and Nd.

2. The rotating vacuum heat treatment equipment, as recited in claim 1, wherein a reinforced plate is provided in said rotating cylinder, and reinforcers are provided in said reinforced plate, said reinforcers are linear or auger-shaped.

3. The rotating vacuum heat treatment equipment, as recited in claim 1, wherein a supporting roller supports said rotating cylinder, and drives said rotating cylinder to rotate.

4. The rotating vacuum heat treatment equipment, as recited in claim 1, wherein a cylinder axle is provided on an end portion of said rotating cylinder, said rotating cylinder is supported by said cylinder axle provided on said end portion of said rotating cylinder, and said cylinder axle drives said rotating cylinder to rotate.

5. The rotating vacuum heat treatment equipment, as recited in claim 1, wherein a cylinder axle is provided on an end portion of said rotating cylinder, a supporting roller supports said rotating cylinder, and said cylinder axle drives said rotating cylinder to rotate.

6. The rotating vacuum heat treatment equipment, as recited in claim 1, wherein a cover is provided on an end portion of said rotating cylinder.

7. The rotating vacuum heat treatment equipment, as recited in claim 1, wherein said rotating cylinder is made of monolayer material or multilayer material, wherein when said rotating cylinder is made of said multilayer material, an inner layer is made of metal material.

8. The rotating vacuum heat treatment equipment, as recited in claim 1, wherein a nozzle is provided on said insulating layer, said nozzle is connected with pipelines of said gas cooling device, and cooled gas is sprayed to said rotating cylinder via said nozzle.

9. The rotating vacuum heat treatment equipment, as recited in claim 1, wherein a number of said rotating cylinder is more than two.

10. The rotating vacuum heat treatment equipment, as recited in claim 1, wherein a reinforced plate is provided in said rotating cylinder, and reinforcers are provided in said reinforced plate, said reinforcers are linear or auger-shaped; a supporting roller supports said rotating cylinder, and drives said rotating cylinder to rotate; a cylinder axle is provided on a first end portion of said rotating cylinder, said rotating cylinder is supported by said cylinder axle provided on said first end portion of said rotating cylinder, and said cylinder axle drives said rotating cylinder to rotate; a cover is provided on a second end portion of said rotating cylinder; said rotating cylinder is made of monolayer material or multilayer material, wherein when said rotating cylinder is made of said multilayer material, an inner layer is made of metal material; a nozzle is provided on said insulating layer, said nozzle is connected with pipelines of said gas cooling device, and cooled gas is sprayed to said rotating cylinder via said nozzle; a number of said rotating cylinder is more than two.

* * * * *